US005402835A

United States Patent [19]

Middleton

[11] Patent Number: 5,402,835

[45] Date of Patent: Apr. 4, 1995

[54] DRUM FUNNEL

[75] Inventor: Dennis G. Middleton, Tyrone, Pa.

[73] Assignee: New Pig Corporation, Tipton, Pa.

[21] Appl. No.: 246,153

[22] Filed: May 19, 1994

[51] Int. Cl.[6] ..... B39B 39/00

[52] U.S. Cl. ..... 141/331; 141/339; 141/98; 220/86.1

[58] Field of Search ..... 141/339, 340, 341, 342, 141/343, 331, 98, 383; 220/86.1, 86.2; 222/252

[56] References Cited

U.S. PATENT DOCUMENTS

| | | | |
|---|---|---|---|
| 860,698 | 7/1907 | Schweinert | 4/295 UX |
| 2,420,668 | 5/1947 | Knight | 141/341 X |
| 2,718,344 | 9/1955 | Troster | 141/86 |
| 4,640,185 | 2/1987 | Joyner | 141/341 X |
| 4,703,867 | 11/1987 | Schoenhard | 141/340 X |
| 4,896,746 | 1/1990 | Desjardins | 141/341 X |
| 5,018,559 | 5/1991 | Branan | 141/339 |
| 5,033,637 | 7/1991 | Webb | 141/339 X |
| 5,086,619 | 2/1992 | Huang et al. | 141/340 X |
| 5,101,869 | 4/1992 | Myers | 141/339 |
| 5,115,554 | 5/1992 | Fell, Sr. | 4/295 X |
| 5,184,751 | 2/1993 | Middleton | 220/694 |
| 5,195,567 | 3/1993 | Tyree et al. | 141/331 |
| 5,316,059 | 5/1994 | Lahnan et al. | 141/340 |

FOREIGN PATENT DOCUMENTS

| | | | |
|---|---|---|---|
| 11064 | of 1905 | United Kingdom | 141/344 |
| 280504 | 4/1928 | United Kingdom | 141/340 |

*Primary Examiner*—Ernest G. Cusick
*Attorney, Agent, or Firm*—Webb Ziesenheim Bruening Logsdon Orkin & Hanson

[57] ABSTRACT

A sealable drum funnel is attached onto a drum by threading the device into the larger bung opening of the drum. The sealable drum funnel includes a funnel body having an open top end and an outlet opening at a bottom end thereof. A sealing lid is coupled to the open top end of the funnel body. A drum coupling is attached to the bottom end of the funnel body. The drum coupling includes a threaded exterior on the lower portion thereof, a threaded interior on at least an upper portion thereof and a passage extending through the drum coupling from the outlet opening of the funnel body.

17 Claims, 2 Drawing Sheets

DRUM FUNNEL

BACKGROUND OF THE INVENTION

1. Field of the Invention

This invention relates to a drum funnel for a drum or vertical container and, more specifically, for a sealing drum funnel for a drum or vertical container holding hazardous waste.

2. Prior Art

U.S. Pat. No. 5,101,869 to Myers discloses a combined funnel and cap member which can be attached to containers for receiving waste fluid. The funnel assembly in the Myers patent allows for venting of the attached container and specifically avoids maintaining a seal between the cap and the funnel body. Additionally, the Myers patent is not adapted for sealing engagement with a drum funnel or similar type container.

As discussed in Applicant's prior U.S. Pat. No. 5,184,751, the containment and removal of liquids contained within a drum such as, for example, a 55 gallon drum have proven to be somewhat burdensome and messy. The process becomes more dangerous when dealing with hazardous materials. 40 C.F.R. §264.173 sets forth the requirements for containers holding hazardous waste stating:

(a) A container holding hazardous waste must always be closed during storage, except when it is necessary to add or remove waste.

(b) A container holding hazardous waste must not be opened, handled, or stored in a manner which may rupture the container or cause it to leak.

The object of the present invention is to provide a funnel for drums or other vertical containers which can be coupled to the drum and sealed while attached to the drum.

SUMMARY OF THE INVENTION

The present invention provides a sealing drum funnel which includes a funnel body having an open top end with an outlet opening at a bottom end thereof. A sealing lid is coupled to the open top end of the funnel body. A drum coupling is attached to the bottom end of the funnel body. The drum coupling includes a threaded exterior on a bottom portion thereof, a threaded interior on at least an upper portion thereof and a passage extending through the drum coupling from the outlet opening of the funnel body.

The present invention may also include a plug member threadably engaging the threaded exterior of the drum coupling to seal the drum coupling passage from the interior of the funnel body. The plug member is preferably a T-type plug including an exterior threaded lower portion, a sealing flange attached to the exterior threaded lower portion, a hexagonal rod extending from the sealing flange and a gripping rod attached to the first rod positioned substantially perpendicular thereto. A neoprene plug gasket may be clamped between the sealing flange and the funnel body for a tight seal.

The sealing lid may be hinged to a first side of the funnel body by a hinge mechanism and secured in a closed position by at least one latch member. The hinge mechanism may be formed of a pair of spaced piano-type hinges positioned on the first side of the funnel body. The latch member may include a lower latch member attached to a second side of the funnel body which is opposed from the first side and a corresponding upper latch member attached to one side of the sealing lid. The sealing lid may include a sealing gasket on an interior portion of the sealing lid, wherein the sealing gasket engages a top edge of the funnel body surrounding the open top end. The sealing gasket may be a gasket which is configured to be compressed when the sealing lid is in the closed position.

The drum coupling may include a shoulder facing the threaded exterior on the lower portion of the drum coupling with a drum gasket engaging the shoulder and configured to be clamped between the shoulder and the drum. The exterior surface of the upper portion of the drum coupling may be formed of a plurality of planar exterior surfaces, such as a square or hexagonal in cross section. This exterior surface will assist in securing the drum funnel to the drum.

These and other advantages of the present invention will become apparent in the description of the preferred embodiment together with the attached drawings wherein like reference numerals represent like elements throughout.

DESCRIPTION OF THE PREFERRED EMBODIMENT

Figure 1:
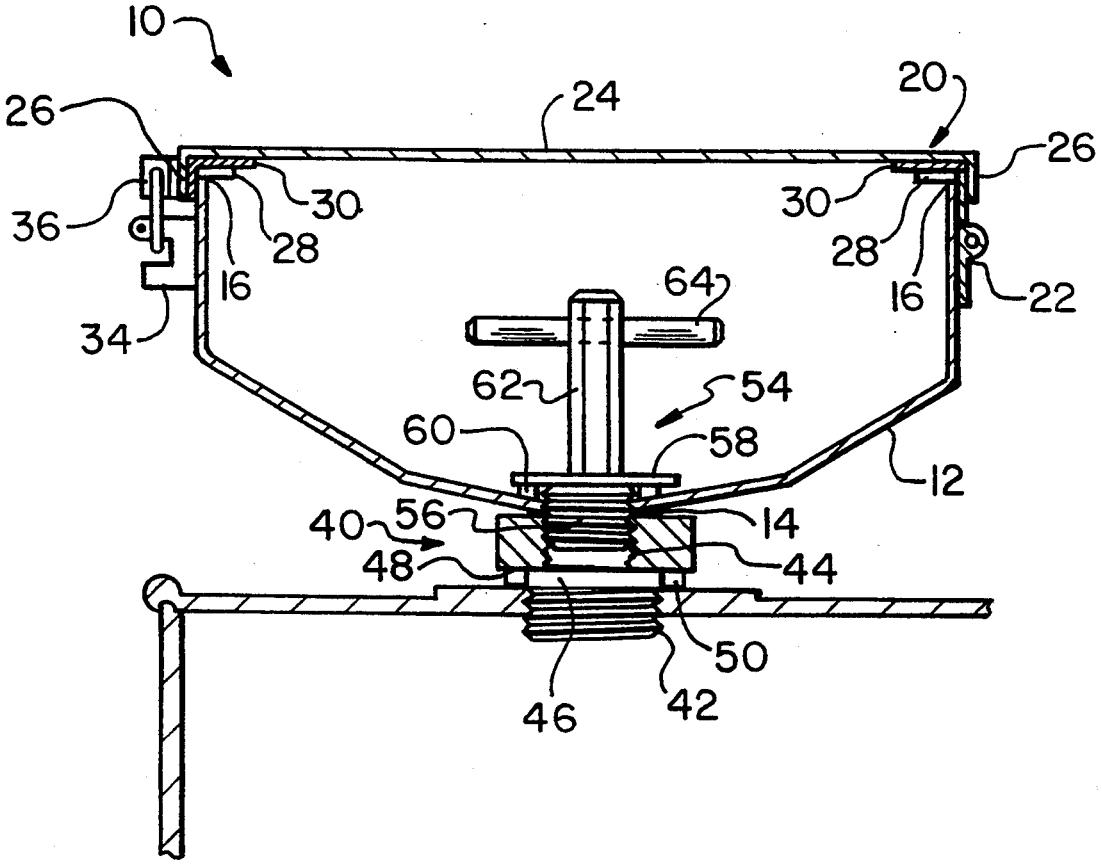
FIG. 1 is a sectional view of the drum funnel according to the present invention threadably engaging a drum.
Figure 2:
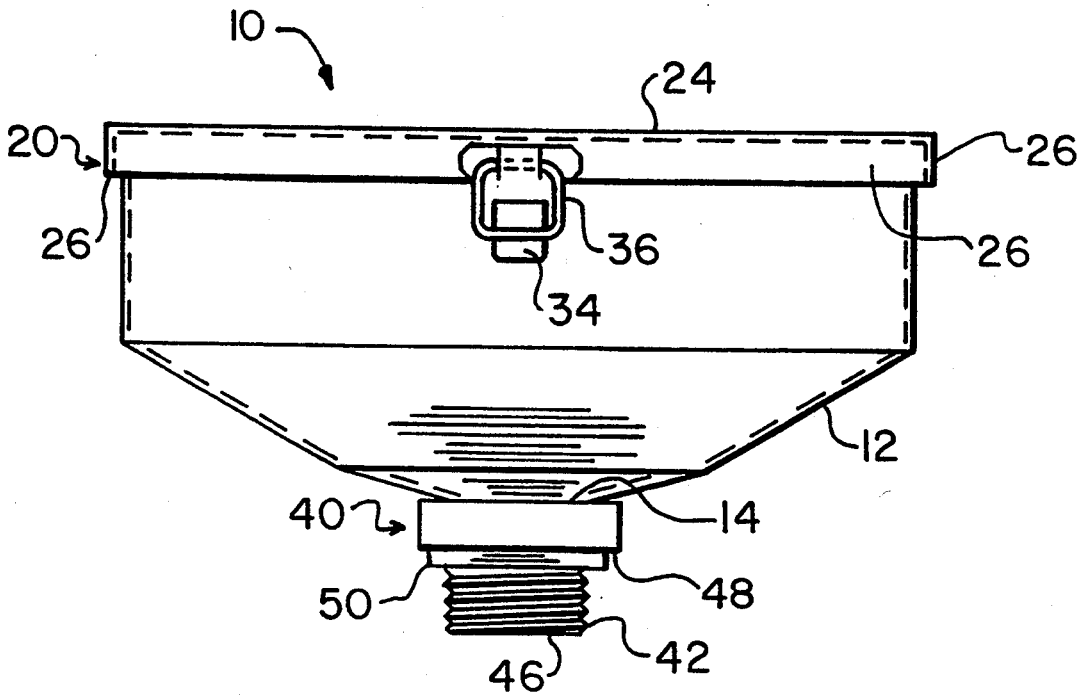
FIG. 2 is a front view of the drum funnel shown in FIG. 1.
Figure 3:
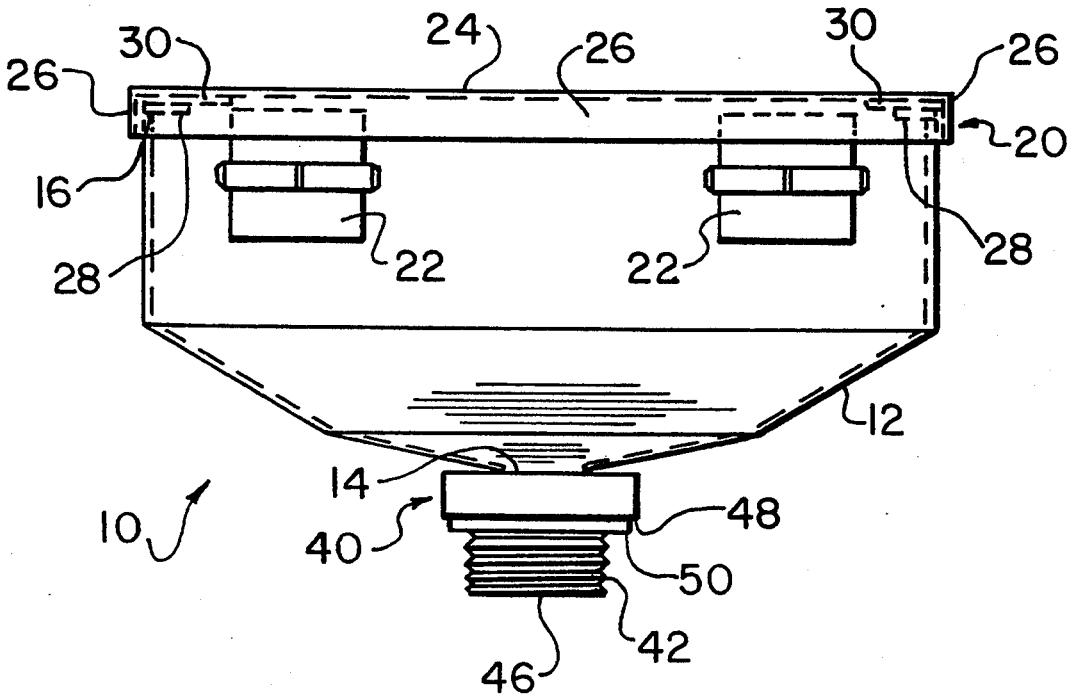
FIG. 3 is a back view of the drum funnel shown in FIGS. 1 and 2.

A sealable drum funnel 10 according to the present invention is illustrated in FIGS. 1–3. The sealable drum funnel 10 includes a funnel body 12 having an open top end and an outlet opening 14 at a bottom end thereof, as best shown in FIG. 1. The funnel body 12 has an upper portion which is substantially square in cross section with a top edge 16 surrounding the open top end. The lower portion of the funnel body 12 is sloped toward the outlet opening 14. Although the funnel body 12 is shown as rectangular or square in the present embodiment, it should be appreciated by those of ordinary skill in the art that various cross sections may also be utilized such as round, oblong or other shapes appropriate to the needs of the user.

A sealing lid 20 is hinged to a first side of the funnel body 12 by a pair of piano hinges 22 positioned at opposite ends of the first side of the funnel body 12 at a position below the top edge 16 (see FIG. 3). The sealing lid 20 includes a flat base 24 and four overlapping side members 26 which extend below the top edge 16 of the funnel body 12 when the sealing lid 20 is in a closed position, as shown in FIGS. 1–3. A sealing gasket 28 is attached to the base 24, such as being secured to a track 30 positioned on the interior surface of the base 24. The sealing gasket 28 may be formed of hydrin and be $\frac{3}{4}''$ wide and $\frac{1}{4}''$ thick. The sealing gasket 28 is positioned to engage the top edge 16 when the sealing lid 20 is in a closed position. When the sealing lid 20 is in the closed position, the sealing gasket 28 should preferably be compressed about 0.060" to assure a watertight seal between the lid 20 and the funnel body 12.

The sealing lid 20 is secured in a closed position by a latching mechanism, as shown in FIGS. 1 and 2. The latching mechanism includes a lower latch member 34 attached to a second side of the funnel body 12 which is opposed from the first side of the funnel body 12 containing the hinges 22. The lower latch member 34 receives an upper latch member 36 positioned on one of the side members 26 of the sealing lid 20. It is preferred that the lower latch member 34 provide for a mechanism for locking the latching mechanism in the closed position. This mechanism could include, for example, a hole positioned in the upper portion of the lower latch member 34 which is adapted to receive a conventional padlock or the like securing the upper latch member 36 thereto. The locking of the latching mechanism will provide added security to the present system.

A drum coupling 40 is attached to the bottom end of the funnel body 12. If the funnel body 12 and drum coupling 40 are metal, this attachment is preferably made by welding the funnel body 12 to the drum coupling 40 to assure a watertight seal therebetween. However, other conventional mechanisms of attachment may also be utilized. The drum coupling 40 includes a threaded exterior 42 on a lower portion thereof, wherein the threads of the threaded exterior 42 correspond with the large bung of a conventional drum or vertical-type container. The drum coupling 40 additionally includes a threaded interior 44 on an upper portion thereof, as shown in FIG. 1. The drum coupling 40 includes a passage 46 extending therethrough which extends from the outlet opening 14 of the funnel body 12. The drum coupling 40 includes a shoulder 48 facing the threaded exterior 42 of the lower portion. A drum gasket 50, which may be made of Buna 70 duro seal, engages the shoulder 48 and is adapted to be clamped between the shoulder 48 and the drum, as shown in FIG. 1, to assure a watertight seal therebetween. The exterior of the upper portion of the drum coupling 40 is preferably square or hexagonal in cross section to assist in securing of the drum funnel 10 to the drum. The provision of a plurality of planar exterior surfaces on the upper portion of the drum coupling 40 will allow for the engagement of a spanner wrench or the like to secure the drum funnel 10 into position.

A T-type plug member 54 threadably engages the threaded interior 44 of the drum coupling 40 to seal the passage 46 from the interior of the funnel body 12. The plug member 54 includes an exterior threaded lower portion 56, wherein the threads of the lower portion 56 substantially match the threaded interior 44 and further include chamfered lower threads to assist in starting of the plug member 54. A sealing flange 58 is attached to the lower portion 56 such that a neoprene plug gasket 60 may be clamped between the sealing flange 58 and the funnel body 12. A hexagonal rod 62 extends from the sealing flange 58 with a gripping rod 64 attached to the hexagonal rod 62 at a position substantially perpendicular thereto. The gripping rod 64 allows for easy securing of the plug member 54 with a hexagonal rod 62 allowing for socket or wrench connection, if needed.

The sealable drum funnel 10 of the present invention operates in the following manner. The sealable drum funnel 10 is threaded onto the large bung of a drum or other container with the threaded exterior 42 of the drum coupling 40 engaging the large bung of the drum, as shown in FIG. 1. The exterior surfaces of the upper portion of the drum coupling 40 can be utilized to securely clamp the drum gasket 50 between the shoulder 48 and the drum assuring an appropriate seal therebetween. When storing material in the drum, the plug member 54 is threaded into the threaded interior 44 of the drum coupling 40 clamping the plug gasket 60 between the sealing flange 58 and the funnel body 12. With the plug member 54 in this position, the drum is completely sealed. Additionally, when storing material in the drum, the sealing lid 20 is preferably latched to the funnel body 12 by the lower and upper latch mechanisms 34 and 36, respectively, and may be locked in the latched position. The latched sealing lid will create a liquid and airtight seal within the funnel body 12 avoiding spillage of material within the funnel body 12 or associated drum. Where material is to be added or removed from the drum, the sealing lid 20 is opened and the plug member 54 is removed, providing easy access to the associated drum which now includes an attached drum funnel 10 to catch and direct spillage to the drum. The threaded interior 44 of the drum coupling 40 is manufactured to accommodate additional accessories such as threaded flame arresters and bottom fill tubes which are used in connection with drum and vertical containers. The threaded interior 44 may extend along the entire length of the drum coupling 40 and passage 46, if needed.

The sealable drum funnel 10 of the present invention may be made of plastic or metal, such as tin, or other such material capable of being utilized for the containment of hazardous materials.

Having described the preferred embodiment of the present invention, it will be obvious to those or ordinary skill in the art that various modifications may be made to the subject invention without departing from the spirit and scope thereof. Accordingly, the scope of the present invention is intended to be defined by the attached claims.

I claim:

1. A sealable drum funnel comprising:

a funnel body having an open top end and an outlet opening at a bottom end thereof;

a sealing lid coupled to said open top, said sealing lid configured to create a liquid and airtight seal within said funnel body;

a drum coupling attached to said bottom end of said funnel body, said drum coupling including a threaded exterior on a lower portion thereof, a threaded interior on at least an upper portion thereof and a passage extending through said drum coupling from said outlet opening of said funnel body; and a plug member threadably engaging said threaded interior of said drum coupling thereby sealing said passage from the interior of said funnel body, wherein said plug member is configured to completely seal the opening in the drum to which said drum coupling is attached.

2. The drum funnel of claim 1 wherein said drum coupling includes a shoulder facing said threaded exterior of said lower portion and a drum gasket engaging said shoulder adapted to be clamped between said shoulder and a drum.

3. The drum funnel of claim 2 wherein said upper portion of said drum coupling includes a plurality of planar exterior surfaces to assist in securing said drum funnel to the drum.

4. The drum funnel of claim 2 wherein said plug member is a T-type plug including:

an exterior threaded lower portion, a sealing flange attached to said exterior threaded lower portion, a plug gasket clamped between said sealing flange and said funnel body, a first rod extending from said sealing flange, and a gripping rod attached to said first rod and positioned substantially perpendicular thereto.

5. The drum funnel of claim 2 wherein said sealing lid is hinged to a first side of said funnel body by at least one hinge member and secured in a closed position by at least one latch member.

6. The drum funnel of claim 2 wherein said sealing lid includes a sealing gasket on an interior portion of said lid, wherein said sealing gasket engages a top edge of said funnel body surrounding said open top end compressing said sealing gasket when said sealing lid is in a closed position.

7. The drum funnel of claim 1 wherein said upper portion of said drum coupling includes a plurality of planar exterior surfaces to assist in securing said drum funnel to a drum.

8. A sealable drum funnel comprising:

a funnel body having an open top end and an outlet opening at a bottom end thereof;

a sealable lid coupled to said open top;

a drum coupling attached to said bottom end of said funnel body, said drum coupling including a threaded exterior on a lower portion thereof, a threaded interior on at least an upper portion thereof and a passage extending through said drum coupling from said outlet opening of said funnel body; and a plug member threadably engaging said threaded interior of said drum coupling thereby sealing said passage from the interior of said funnel body, wherein said plug member is a T-type plug including:

an exterior threaded lower portion, a sealing flange attached to said exterior threaded lower portion, a plug gasket configured to be clamped between said sealing flange and said funnel body, a first rod extending from said sealing flange, and a gripping rod attached to said first rod and positioned substantially perpendicular thereto.

9. The drum funnel of claim 8 wherein said exterior threaded lower portion of said plug member includes threads substantially matching said threaded interior of said drum coupling, said exterior threaded lower portion of said plug member having chamfered lower threads, said first rod being hexagonal in cross section and said plug gasket being a neoprene gasket.

10. The drum funnel of claim 8 wherein said sealing lid is hinged to a first side of said funnel body by at least one hinge member and secured in a closed position by at least one latch member.

11. The drum funnel of claim 10 wherein said latch member includes a lower latch member attached to a second side of said funnel opposed from said first side and an upper latch member attached to one side of said sealing lid.

12. The drum funnel of claim 10 wherein said sealing lid includes a sealing gasket on an interior portion of said sealing lid, wherein said sealing gasket engages a top edge of said funnel body surrounding said open top end when said sealing lid is in a closed position.

13. The drum funnel of claim 12 wherein said sealing gasket is compressed about 0.060" when said sealing lid is in said closed position.

14. A sealable drum funnel comprising:

a funnel body having an open top end and an outlet opening at a bottom end thereof;

a sealing lid hinged to a first side of said funnel body by at least one hinge member and secured in a closed position by at least one latch member;

a drum coupling attached to said bottom end of said funnel body, said drum coupling including a threaded exterior on a lower portion thereof, a threaded interior on at least an upper portion thereof and a passage extending through said drum coupling from said outlet opening; and a plug member threadably engaging said threaded interior of said drum coupling sealing said passage from the interior of said funnel body, wherein said plug member includes:

an exterior threaded lower portion, a sealing flange attached to said exterior threaded lower portion, and a plug gasket configured to be clamped between said sealing flange and said funnel body.

15. The drum funnel of claim 14 wherein said sealing lid includes a sealing gasket on an interior portion of said sealing lid, wherein said sealing gasket engages a top edge of said funnel body surrounding said open top end compressing said sealing gasket when said sealing lid is in a closed position.

16. The drum funnel of claim 14 wherein said drum coupling includes a shoulder facing said threaded exterior on said lower portion and a drum gasket engaging said shoulder adapted to be clamped between said shoulder and a drum.

17. The drum funnel of claim 16 wherein said sealing lid includes a sealing gasket on an interior portion of said sealing lid, wherein said sealing gasket engages the top edge of said funnel body surrounding said open top end compressing said sealing gasket when said sealing lid is in said closed position.

* * * * *